US007137941B2

(12) United States Patent
Gamache et al.

(10) Patent No.: US 7,137,941 B2
(45) Date of Patent: Nov. 21, 2006

(54) APPARATUS AND METHOD FOR FORMING A HEMMED EDGE ON CARTON BLANKS

(75) Inventors: Brian N. Gamache, Mont Vernon, NH (US); Peter M. Siemiesz, Bedford, NH (US); Michael A. Sutcliffe, Hudson, NH (US); Terence Sharples, Derry, NH (US)

(73) Assignee: Folder-Gluer Technical Services Group, Inc., Pelham, NH (US)

( * ) Notice: Subject to any disclaimer, the term of this patent is extended or adjusted under 35 U.S.C. 154(b) by 1 day.

(21) Appl. No.: 10/925,249

(22) Filed: Aug. 24, 2004

(65) Prior Publication Data

US 2006/0046916 A1 Mar. 2, 2006

(51) Int. Cl.
*B31B 1/64* (2006.01)

(52) U.S. Cl. ..... 493/135; 493/134; 493/409

(58) Field of Classification Search ..... 493/135, 493/355, 133, 134, 409, 72
See application file for complete search history.

(56) References Cited

U.S. PATENT DOCUMENTS

| | | | | | |
|---|---|---|---|---|---|
| 3,058,868 | A | | 10/1962 | Schroeder | 156/153 |
| 3,130,649 | A | | 4/1964 | Striplin et al. | 93/36.01 |
| 3,380,229 | A | * | 4/1968 | Nelson | 53/376.7 |
| 3,495,507 | A | | 2/1970 | Haas et al. | 93/94 |
| 3,604,317 | A | | 9/1971 | Baun | 93/58 ST |
| 3,654,842 | A | | 4/1972 | Schwenk | 93/94 PS |
| 3,716,435 | A | | 2/1973 | Jensen et al. | 156/195 |
| 3,788,917 | A | * | 1/1974 | Linda | 156/82 |
| 3,847,540 | A | * | 11/1974 | Farfaglia et al. | 432/230 |
| 4,417,883 | A | * | 11/1983 | Granger et al. | 493/403 |
| 4,540,391 | A | | 9/1985 | Fries, Jr. | 493/287 |
| 4,614,512 | A | | 9/1986 | Capdeboscq | 493/441 |
| 4,617,211 | A | | 10/1986 | Fries, Jr. | 428/35 |
| 4,682,977 | A | | 7/1987 | Buxton | 493/358 |
| 4,708,708 | A | | 11/1987 | Fries, Jr. | 493/357 |
| 4,757,936 | A | * | 7/1988 | Homma et al. | 229/5.5 |
| 4,895,611 | A | * | 1/1990 | Bryniarski et al. | 156/252 |
| 4,931,031 | A | * | 6/1990 | Lisiecki | 493/355 |
| 4,979,932 | A | | 12/1990 | Burnside | 493/134 |
| 5,236,408 | A | | 8/1993 | McAdam, III et al. | 493/355 |
| 5,385,527 | A | | 1/1995 | Fukada et al. | 493/135 |
| 5,549,539 | A | * | 8/1996 | Rautenberg | 493/402 |
| 6,458,110 | B1 | * | 10/2002 | Lavon et al. | 604/385.01 |

* cited by examiner

*Primary Examiner*—Sameh H. Tawfik
(74) *Attorney, Agent, or Firm*—John H. Pearson, Jr. Esq.; Walter F. Dawson, Esq.; Pearson & Pearson, LLP.

(57) ABSTRACT

An apparatus and method for forming a hem on a 5$^{th}$ panel of a liquid carton blank comprising a skiving section, a stepped creaser section, a burner section, a vacuum hemmer section, and a sealer section. Carton blanks are fed into the skiver section and exit from the sealer section at a high rate of speed. The final folding step in the process is performed by a vacuum hemmer which comprises a belt with holes for pulling a vacuum to securely hold the carton blank during the second and final folding of the skived portion of the 5$^{th}$ panel.

5 Claims, 20 Drawing Sheets

APPARATUS AND METHOD FOR FORMING A HEMMED EDGE ON CARTON BLANKS

BACKGROUND OF THE INVENTION

1. Field of the Invention

This invention relates generally to the field of carton folding, gluing and sealing and in particular to an improved apparatus and method for skiving, hemming and pre-sealing edges of liquid carton blanks with a vacuum hemmer apparatus.

2. Description of Related Art

Although carton blanks are formed from a wide variety of materials, this invention is related to the manufacture of cartons made from carton blanks having surface coatings of a thermoplastic material. The carton blanks generally are laminated with a paper board core and outer coatings of a high or low density polyethylene or other thermoplastic. The laminate may contain an optional barrier of metallic foil or other material that forms an essentially gas impermeable membrane.

In applications where a box is designed to store liquids or to store contents in a moist environment, overlapping the edges of a carton to form the box does not produce a longitudinal seam that maintains its integrity over an extended time interval for such applications. The conventional overlapped configuration exposes one edge of the paper board core that is the center of the laminate. If that edge lies inside the carton, the liquid contents can wick through the paper board core and eventually destroy the carton. Hence, it is important that the folded carton prevent such wicking in order to maintain the integrity of the longitudinal seam.

U.S. Pat. No. 5,236,408, issued Aug. 17, 1993 to Hugh A. McAdam, III, et al. and assigned to International Paper Box Machine Company, Inc. of Nashua, N.H., discloses related art and a method and apparatus for forming carton blanks into folded cartons with hemmed edges. A skiving apparatus removes a portion of a carton blank material at a predetermined area such as a first half of an edge portion. Then a folding apparatus folds the skived portion onto the blank, irons it, and then opens the hem to lie in a predetermined plane that intersects the plane of the blank. Superheated air activates a thermoplastic coating at the inner half of the edges adjacent to the skived portion of the area to be hemmed. Hemming and sealing apparatus seals the skived outer half of the edge portion fully onto the coating on the inner thermoplastic. However, during the hemming operation the blank is not securely held at the edge being hemmed.

U.S. Pat. No. 4,540,391 issued Sep. 10, 1985 to Carl J. Fries, Jr. and assigned to International Paper Company of New York, N.Y. discloses an apparatus for skiving and hemming one or more edges of a paperboard web or blank to improve the sealing qualities of a container made from paperboard. The blank is skived twice, once to define an oblique surface and once to make a flat skived surface. The latter is folded over the former and heat sealed to a heat sealable material adjacent the skived region, defining a wedge-shaped edge portion which is ironed to produce a substantially flat sheet. Fries, Jr. discloses the use of vacuum suction to remove debris material during the pre-hemming milling operation which accomplishes the skiving.

U.S. Pat. No. 4,682,977 issued Jul. 28, 1987 to Gerald W. Buxton and assigned to Paper Converting Machine Company of Green Bay, Wis. discloses an apparatus for folding spaced segments of web material such as diapers having intermediate side flaps overfolded in the crotch portion making use of a vacuumized continuously moving belt system for gripping one surface of a planar web. Vacuum is applied to the bottom surface of a continuous belt means by means of a plenum chamber and conduits coupled to a vacuum pump. Continuous belt is equipped with sprocket holes engaging pins on head and tail sprockets. The continuous inner belt is equipped with a number of cutouts which allow vacuum to be applied to portions of the web which are not to be folded so as to maintain it under control.

SUMMARY OF THE INVENTION

Accordingly, it is therefore an object of this invention to provide a hem on the $5^{th}$ panel of a carton blank with a minimum amount of apparatus and process steps.

It is an object of this invention to provide a hemming apparatus for making a hem on the $5^{th}$ panel of a carton blank comprising a skiver section, a stepped creaser section, a burner section, a vacuum hemmer section, and a sealer section and means for conveying the carton blank through each section.

It is another object of this invention to provide a method of hemming the $5^{th}$ panel of a carton blank by skiving, creasing and folding (approximately 90 degrees) an outer portion of the $5^{th}$ panel of a carton blank, heating the unskived outer portion and folding the skived portion another 90 degrees, which places the skived outer portion under the unskived outer portion of the $5^{th}$ panel, and then pressing them together to form a sealed hem.

It is a further object of this invention to provide a folding spiral attached to a vacuum hemmer which securely holds the carton blank during the folding by the spiral of the skived edge to form a hem.

These and other objects are further accomplished by a hemming apparatus comprising means for conveying successive carton blanks along a paper line axis of the apparatus, means for forming a crease a predetermined distance from an edge of the carton blank and folding the edge along the crease in a predetermined plane, means for heating a thermoplastic coating on the unfolded portion of the edge adjacent to the crease, means for folding the folded edge under the heated unfolded portion of the edge, the folding means comprises a spiral attached to a vacuum hemmer, and means for sealing the folded portion of the edge under the unfolded portion of the edge having the heated thermoplastic coating to form a sealed hem on the edge of the carton blank. The crease forming and folding means comprises a female stepped roll and a male stepped roll mounted in a plane opposite each other. The heating means comprises a side panel and a top panel having a predetermined spacing for diverting streams of hot air toward the unfolded portion of the edge. The vacuum hemmer comprises a belt having a plurality of holes, the belt being positioned in a vertical plane around two spaced apart idler rolls, a drive roll and a take-up roll, a plate having a plurality of openings is positioned immediately above a lower horizontally traveling portion of the belt, a hood positioned on top of the plate for enabling a vacuum to retain each of the carton blanks as they move along the belt, and a spiral having predetermined contoured surfaces and mounted alongside the lower horizontally traveling portion of the belt for turning up to 180 degrees the previously folded edge of the carton blanks to place the folded edge under the heated unfolded portion of the edge. The plate having a plurality of openings comprises a coating of friction reducing material. The sealing means comprises an upper crusher roll and a lower crusher roll, positioned in a plane opposite each other and spaced apart, for the folded portion under the heated unfolded portion to pass between the upper crusher roll and the lower crusher roll to form the sealed hem.

The objects are further accomplished by a hemming apparatus comprising a means for conveying successive carton blanks along a paper line axis of the apparatus, means for skiving a predetermined outer portion of an edge of each of the carton blanks, means for forming a crease between the skived and unskived portions of the edge of each of the carton blanks and folding the skived portion of the edge along the crease in a predetermined plane, means for heating a thermoplastic coating on the unskived portion of the edge adjacent to the skived portion, means for folding the skived edge, previously folded in a predetermined plane, under the unskived heated portion of the edge, the folding means comprises a spiral attached to a vacuum hemmer, and means for sealing the skived portion of the edge under the unskived portion of the edge having the heated thermoplastic coating to form a sealed hem on the edge of the carton blank. The carton blank comprises a $5^{th}$ panel for forming the sealed hem thereon. The skiving means removes a predetermined amount of material from the outer portion of the edge of each of the carton blanks. The crease forming and folding means comprises a female stepped roll and a male stepped roll mounted in a plane opposite each other. The heating means comprises a side panel and a top panel having a predetermined spacing for diverting streams of hot air toward the unskived portion of the edge. The vacuum hemmer comprises a belt having a plurality of holes, the belt being positioned in a vertical plane around two spaced apart idler rolls, a drive roll and a take-up roll, a plate having a plurality of openings being positioned immediately above a lower horizontally traveling portion of the belt, a hood positioned on top of the plate for enabling a vacuum to retain each of the carton blanks as they move along the belt, and a spiral having predetermined contoured surfaces and mounted alongside the lower horizontally traveling portion of the belt for turning up the previously folded edge of the carton blanks to be under the unskived portion of the edge. The spiral turns the previously folded skived edge up to 180 degrees. The plate having a plurality of openings comprises a coating of friction reducing material. The sealing means comprises an upper crusher roll and a lower crusher roll positioned in a plane opposite each other.

The objects are further accomplished by a hemming apparatus comprising a means for conveying successive carton blanks along a paper line axis of the apparatus, means for skiving a predetermined outer portion of an edge of each of the carton blanks, means for forming a crease between the skived and unskived portions of the edge of each of the carton blanks, means for heating a thermoplastic coating on the unskived portion of the edge adjacent to the skived portion, means for folding the skived edge, under the unskived heated portion of the edge, the folding means comprises a spiral attached to a vacuum hemmer, and means for sealing the skived portion of the edge under the unskived portion of the edge having the heated thermoplastic coating to form a sealed hem on the edge of the carton blank. The carton blank comprises a $5^{th}$ panel for forming the sealed hem thereon. The skiving means removes a predetermined amount of material from the outer portion of the edge of the carton blank. The crease forming means comprises a non-stepped creaser having rolls on each side of a male creaser rule on a bottom portion of the creaser and female creaser rolls on a top portion of the creaser. Also, the crease forming means comprises a non-stepped creaser having rolls on each side of a male creaser rule on a top portion of the creaser and female creaser rolls on a bottom portion of the creaser.

The objects are further accomplished by a method of forming a sealed hem on an edge of a carton blank comprising the steps of conveying successive carton blanks along a paper line axis of a hemming apparatus, skiving a predetermined outer portion of the edge of each of the carton blanks, forming a crease between the skived and unskived portions of the edge of each of the carton blanks and folding the skived portion of the edge along the crease in a predetermined plane, heating a thermoplastic coating on the unskived portion of the edge adjacent to the folded portion, folding the skived edge, previously folded in a predetermined plane, under the unskived heated portion of the edge by means of a spiral attached to a vacuum hemmer, and sealing the skived portion of the edge folded under the unskived portion of the edge having the heated thermoplastic coating to form the sealed hem. The step of skiving a predetermined outer portion of an edge comprises the step of removing a predetermined amount of material from the outer portion of the edge of the carton blank. The step of forming a crease between the skived and unskived portion of the edge of the carton blank and folding the skived portion of the edge along the crease comprises the step of providing a female stepped roll and a male stepped roll mounted in a plane opposite each other for the edge of the carton blank to pass therebetween. The step of heating a thermoplastic coating comprises the step of providing a heating means having a side panel and a top panel with a predetermined spacing for diverting streams of heated air toward the unskived portion of the edge. The step of folding the skived edge under the unskived heated portion of the edge comprises the steps of providing a belt having a plurality of holes, the belt being positioned in a vertical plane around two spaced apart idler rolls, a drive roll and a take-up roll, positioning a plate having a plurality of openings immediately above a lower horizontally traveling portion of the belt, mounting a hood on top of the plate for enabling a vacuum to hold each of the carton blanks on the belt, and mounting a spiral having predetermined contoured surfaces alongside the lower horizontally traveling portion of the belt for folding the previously folded skived edge of the carton blank up and under the unskived edge. The step of sealing the unskived portion of the edge comprises the step of providing an upper crusher roll and a lower crusher roll positioned in a plane opposite each other for the hemmed edge of the carton blanks to pass therebetween.

The objects are further accomplished by a vacuum hemmer comprising a driver belt having a plurality of holes, the belt being positioned in a vertical plane around two spaced apart idler rolls, a drive roll and a take-up roll, a plate having a plurality of openings being positioned immediately above a lower horizontally traveling portion of the belt, a hood positioned on top of the plate for enabling a vacuum to retain each of the carton blanks as they move along the belt, and a spiral having predetermined contoured surfaces and mounted alongside the lower horizontally traveling portion of the belt for folding a first portion of an edge of carton blanks to be under a second portion of the edge to form a hem. The spiral folds the first portion of the edge up to 180 degrees to be under the second portion of the edge. The plate having a plurality of openings comprises a coating of friction reducing material.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENT

Figure 1:
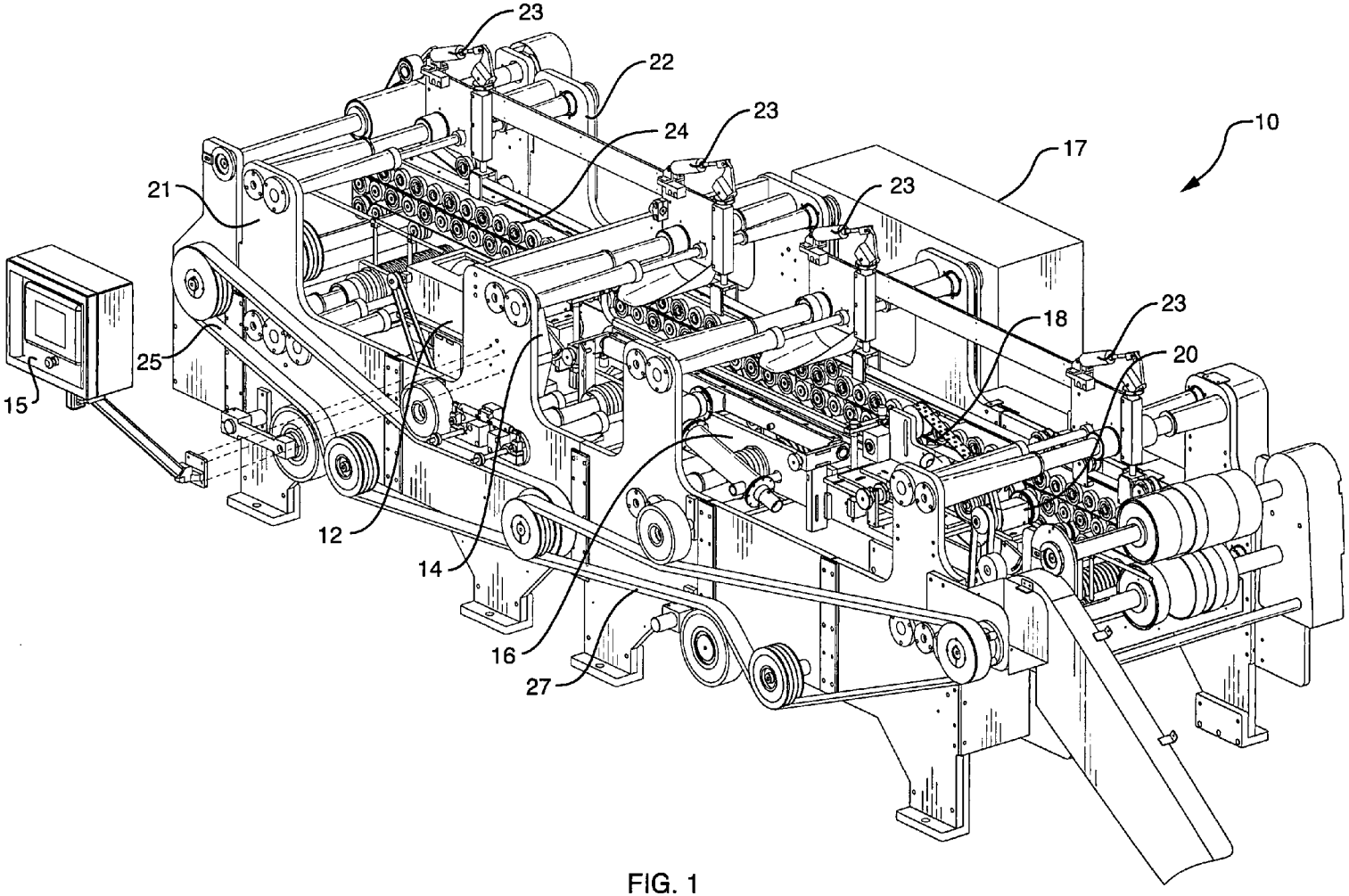
FIG. 1 is an isometric view of a skive/hem/preseal assembly for hemming an edge of a carton blank according to the invention.
Figure 2A:
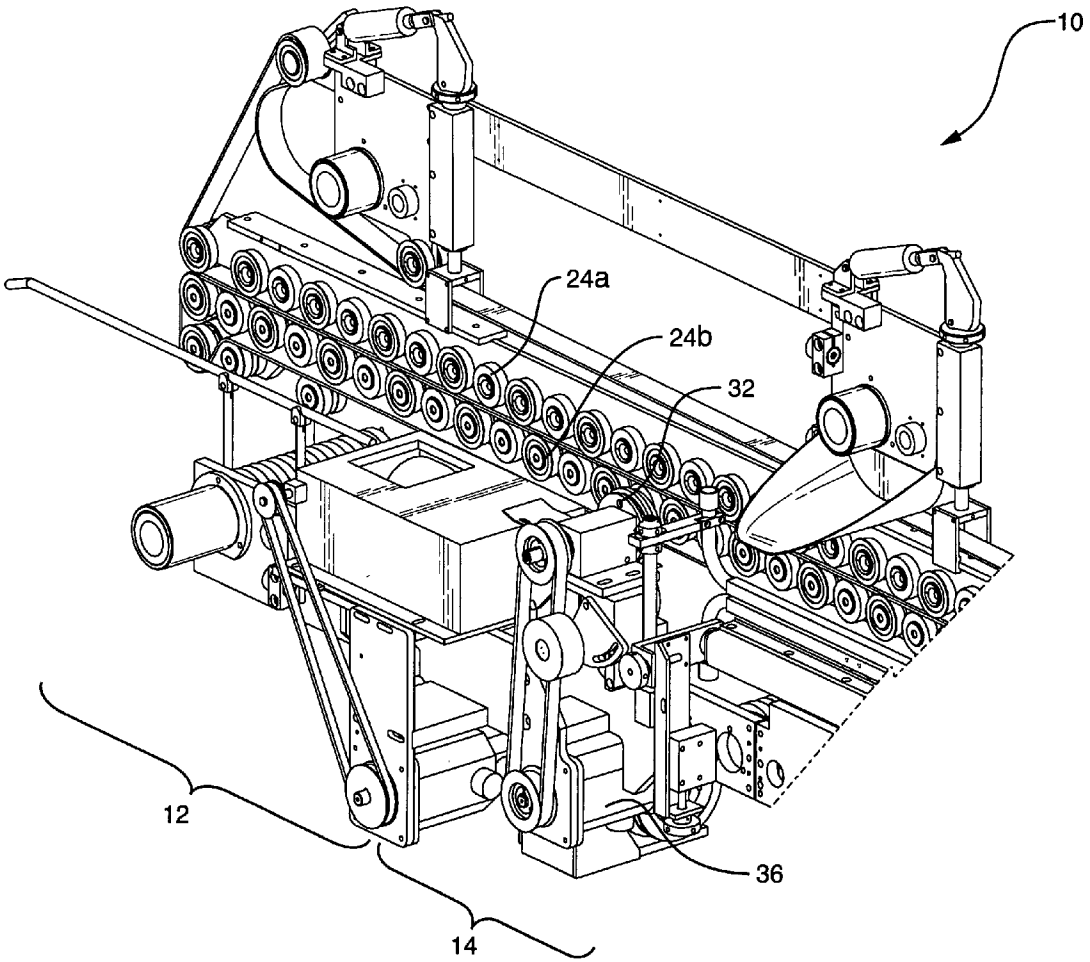
FIGS. 2A and 2B taken together are a right side perspective view of the skive/hem/preseal apparatus with side structures removed.
Figure 2B:
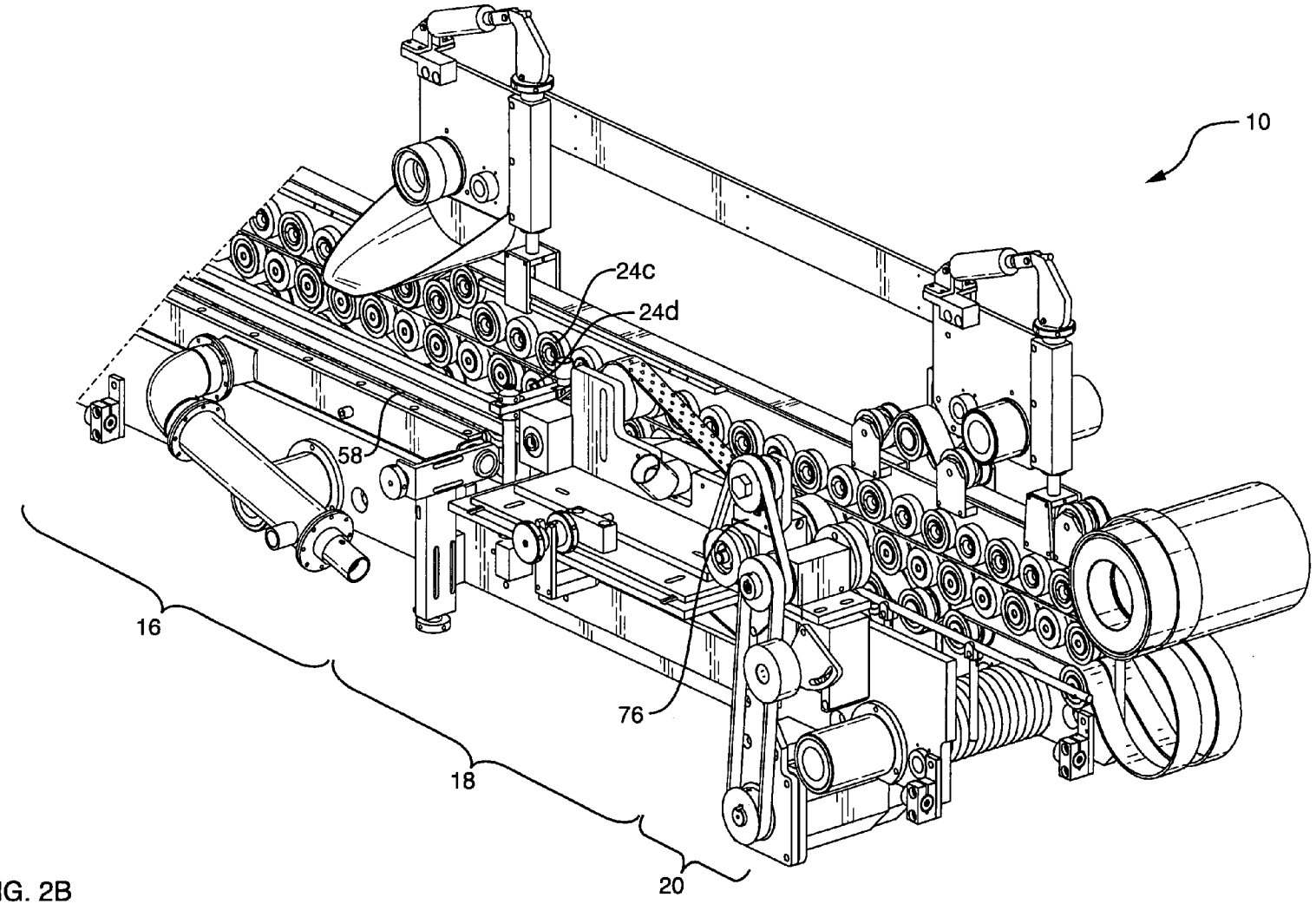
Figure 3A:
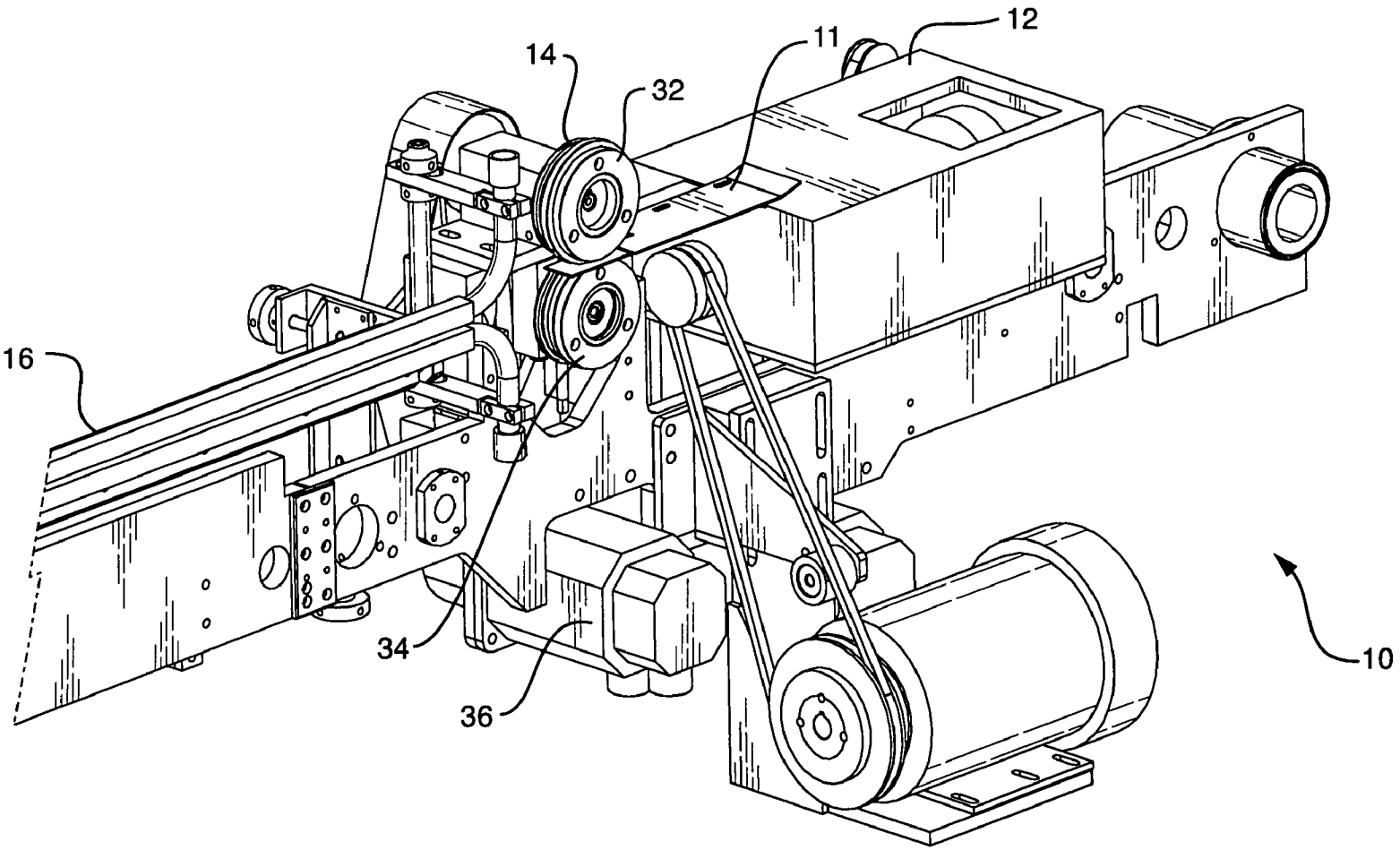
FIGS. 3A and 3B taken together are a left side perspective view of a skive/hem/preseal apparatus with side structures removed.
Figure 3B:
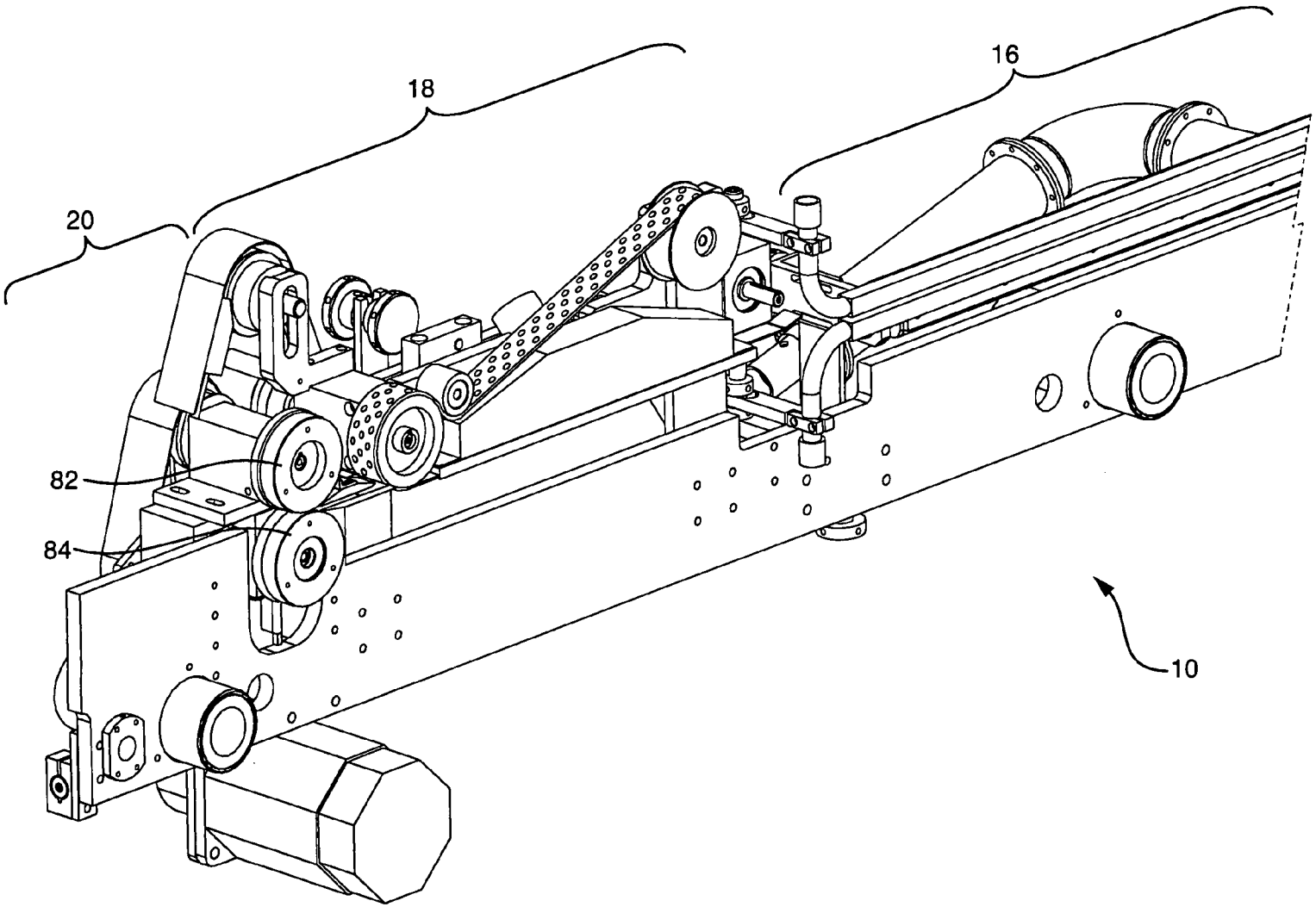

Referring to FIGS. 1, 2A, 2B, 3A and 3B, FIG. 1 is an isometric view of a skiver/hem/preseal assembly 10, which will be referred to as a hemming apparatus 10, according to the invention comprising a skiver section 12, a stepped creaser section 14, a hot air burner section 16, a vacuum hemmer section 18, a sealer section 20, main frame 21, 22, conveyor system 24, control and display console 15 and electrical cabinet 17. FIGS. 2A and 2B together show a right side perspective view of the hemming apparatus 10 with side frame 21 removed to disclose the above sections of the invention. FIGS. 3A and 3B together show a left side perspective view of the hemming apparatus 10 with side structures of the frame 22 removed to disclose the stepped creaser rolls 32, 34, the vacuum hemmer section 18 and the sealing crusher rolls 82, 84.

Figure 13:
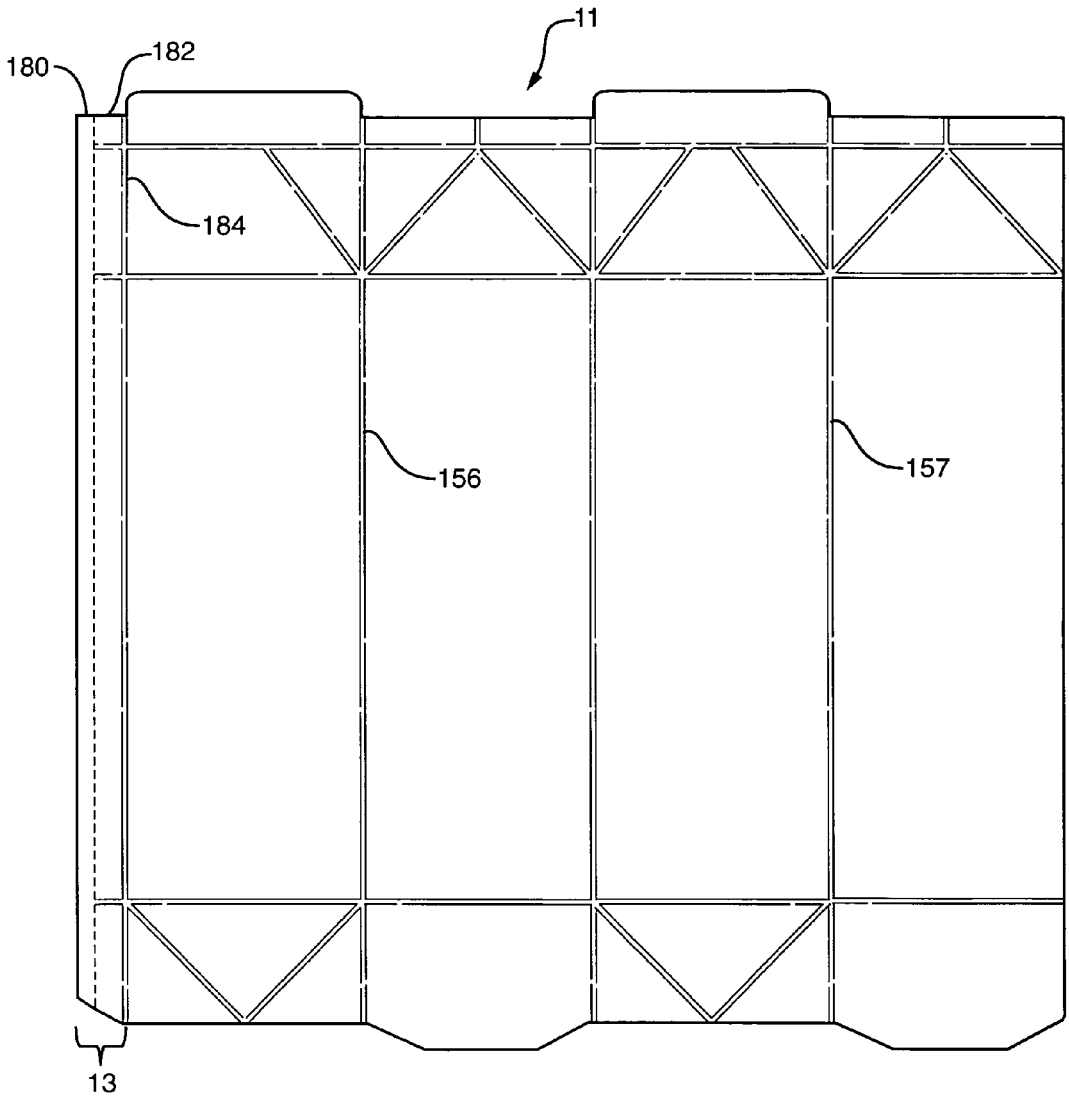
FIG. 13 is a top view of a carton blank having five panels showing a $5^{th}$ panel which is to be hemmed.

Referring to FIG. 13, a top view of a carton blank 11 is shown having a "$5^{th}$" panel 13. The hemming apparatus 10 forms a hem 190 (FIG. 18) on the "$5^{th}$" panel 13 of a carton blank 11, and the carton blank 11 is subsequently folded along score lines 156, 157 and sealed, by other machinery into a carton for holding typically a liquid. Various elements of the apparatus 10 are shown in FIGS. 1, 2A, 2B, 3A and 3B, and some elements are known to one of ordinary skill in the art such as the skiver section 12 and the main frame 21, 22 which are not described in any detail.

Figure 14:
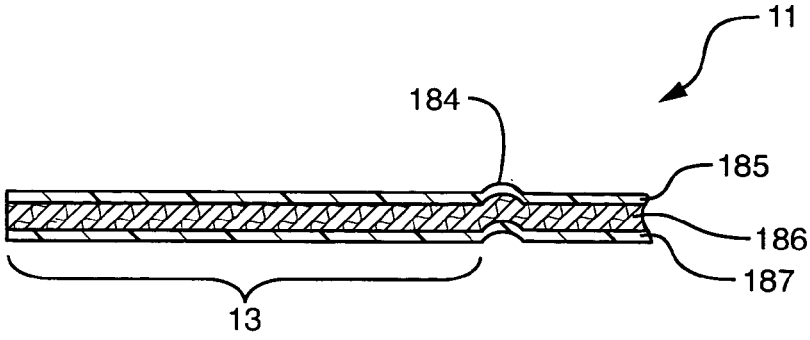
FIG. 14 is an enlarged cross section of a portion of a carton blank showing the $5^{th}$ panel.
Figure 15:
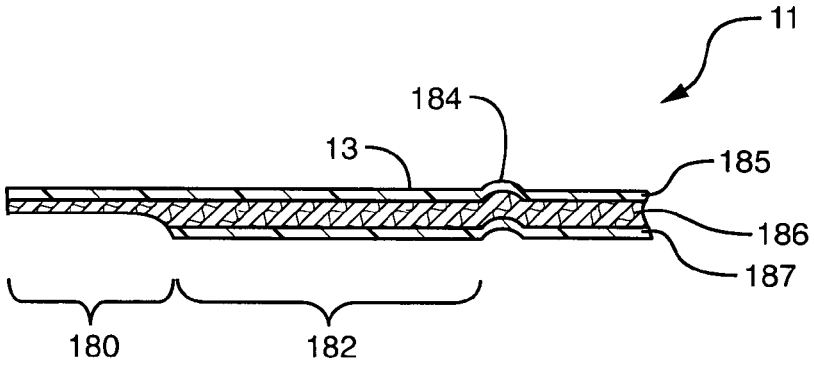
FIG. 15 is an enlarged cross-section of a portion of a carton blank showing a skived portion of the $5^{th}$ panel.
Figure 15A:
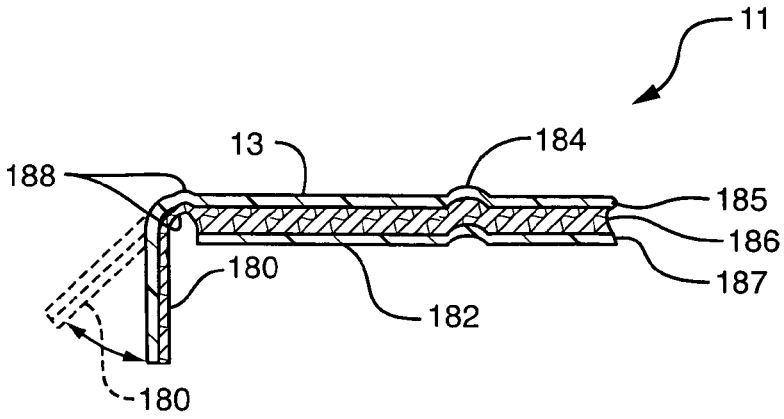
FIG. 15A is an enlarged cross section of a portion of a carton blank showing the skived portion of the $5^{th}$ panel folded about a step crease.
Figure 16:
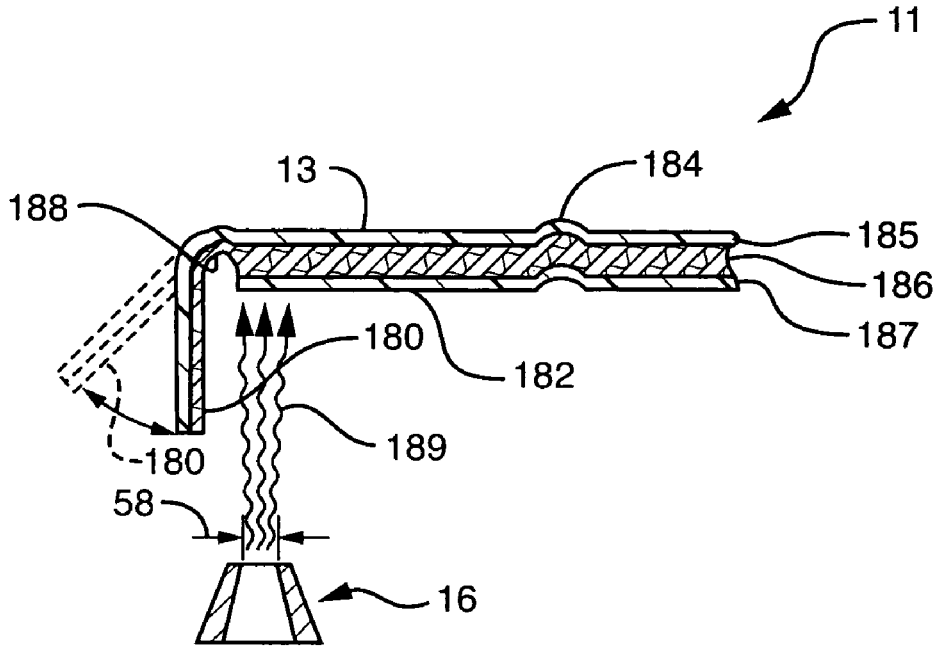
FIG. 16 is an enlarged cross-section of a portion of a carton blank showing the skived area folded 90 degrees and an adjacent unskived portion being heated.
Figure 17:
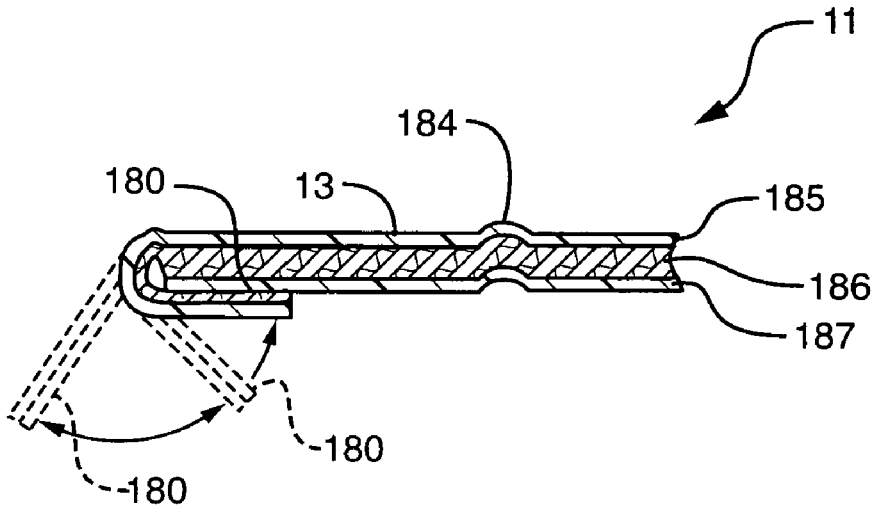
FIG. 17 is an enlarged cross-section of a portion of the carton blank showing the $5^{th}$ panel skived area folded under the unskived area prior to being pressed together forming a hem.
Figure 18:
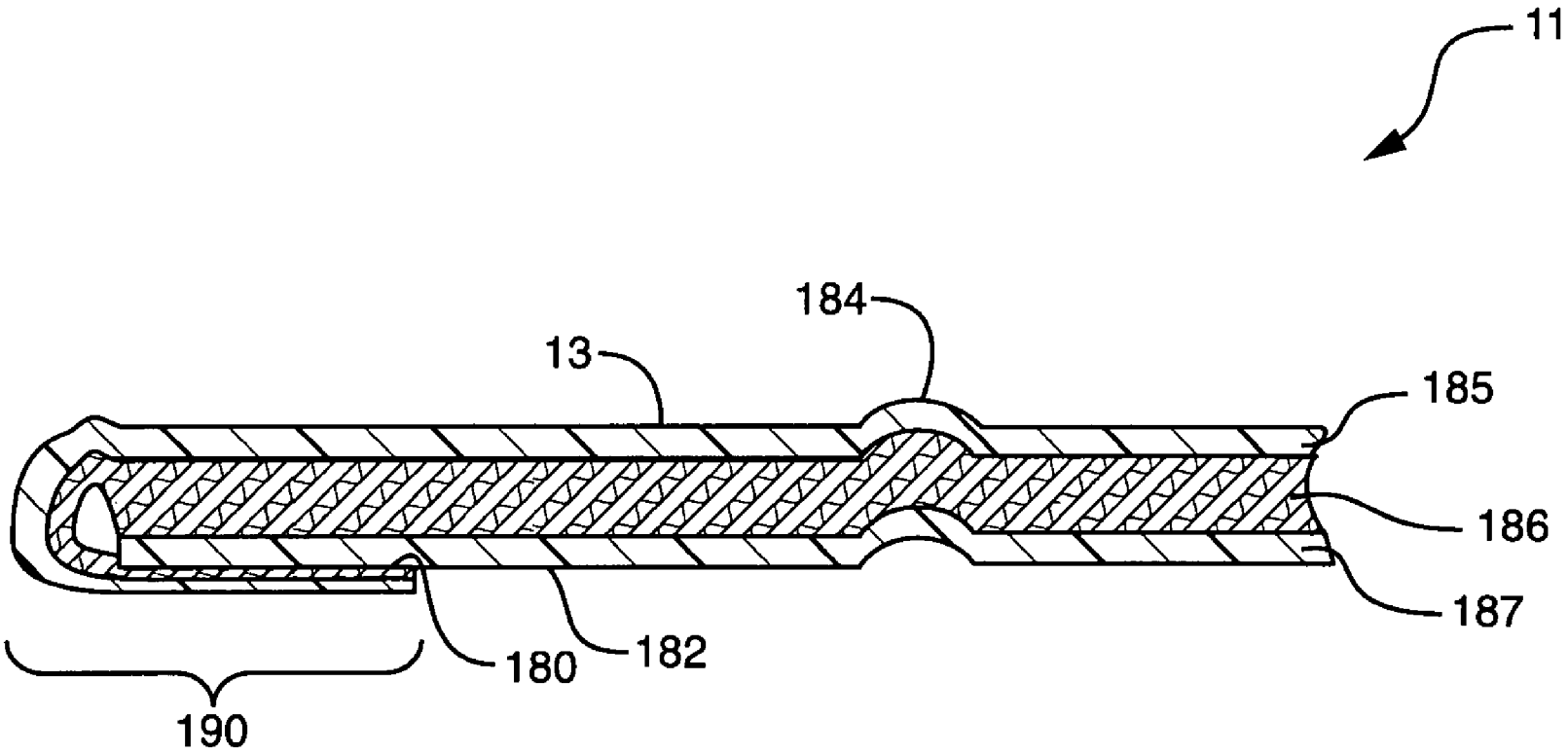
FIG. 18 is an enlarged cross-section of the $5^{th}$ panel showing the hemmed edge.

Referring to FIGS. 14—18, enlarged cross-sections of the carton blank 11 are shown at various steps of the hemming process as the carton blank 11 passes through the hemming apparatus 10. FIG. 14 shows an enlarged cross-section of the $5^{th}$ panel 13 of the carton blank 11 comprising a paper board core 186 with a thermoplastic coating 185 covering the top surface of the paper board core 186, and a thermoplastic coating 187 covering the bottom surface of the paper board core 186. FIG. 15 shows the $5^{th}$ panel 13 after passing through the skiving section 12 where a portion of material is removed from the lower surface of the outer portion 180 of the $5^{th}$ panel 13 of the carton blank 11. FIG. 15A shows the $5^{th}$ panel after passing through the stepped creaser section 14 where the crease 188 is made between the skived portion 180 and the unskived portion 182 and where the skived portion 180 is folded downward approximately ninety degrees with respect to the horizontal plane of the carton blank 11; the folded portion tends to move back toward its original position (shown in phantom). The carton blank 11 then passes through the burner section 16 where a narrow stream of very hot air 189 depicted in FIG. 16 flows to a narrow portion of the unskived lower surface of the $5^{th}$ panel 13 thereby heating the thermoplastic material 187 in that area. FIG. 17 shows the $5^{th}$ panel after passing through the vacuum hemmer section 18 whereby the folded skived portion 180 is folded back down to 90 degrees relative to the horizontal plane of the carton blank 13 and continues folding from 90 degrees up to 180 degrees upward so that the skived portion 180 comes in contact with the heated unskived portion 182 of the $5^{th}$ panel 13. FIG. 18 shows the $5^{th}$ panel after passing through the sealer section 20 where the skived portion 180 and the adjacent heated unskived portion 182 are pressed together forming the hem 190 on the $5^{th}$ panel 13.

The hemming apparatus 10 is operated by the control and display console 15 and electrical power and signal distribution is provided by the electrical cabinet 17.

The control and display console 15 provides the interface between an operator and the hemming apparatus 10 by allowing the operator to start and stop various motors known in the art as desired. The operator also runs the control and display console 15 as a diagnostic tool. A screen displays the speed of motors driving the various sections of the hemming apparatus 10 and the temperature of certain components. Troubleshooting messages are displayed on the screen for overloads, flame loss or motor disabled occurrences. The control and display console 15 may be embodied by models manufactured by Allen Bradley of Milwaukee, Wis.

The electrical cabinet 17 comprises the Program Logic Controller (PLC), servo drives for the stepped creaser section 14, sealer section 20, vacuum hemmer section 18, and a feed roll, and variable frequency drivers for the hot air burner section 16, skiver section 12 and a feed motor. The PLC outputs control the motor ON/OFF commands and the speed inputs are entered by the operator via the control and display console 15. A burner control operates the hot air burner section 16 and includes built-in safety features such as flame out signals fed directly to the burner control from a flame rod; if no flame is detected, a gas valve is shut off and the burner control resets. The servo drives and variable frequency drives may be embodied by models manufactured by Allen Bradley of Milwaukee, Wis. and the burner control is manufactured by Honeywell of Golden Valley, Minn.

Referring to FIGS. 2A and 2B, a plurality of carton blanks 11 are fed into the skiver section 12 end of the hemming apparatus 10, and they are transferred in a horizontal plane from one section to the next from left to right by the conveyor system 24. The conveyor system 24 comprises top and bottom carrier assemblies including front top and bottom belted carriers 24*a*, 24*b* and rear top and bottom belted carriers 24*c* and 24*d*, and attached to the top carrier assemblies are air cylinders 23 for raising and lowering the top front and rear belted carriers 24*a*, 24*c*.

Still referring to FIGS. 2A and 2B, the skiver section 12 removes or skives a certain percentage of material from an outer portion 180 of the $5^{th}$ panel of a carton blank 11 and generally the percentage is 50% to 75% of the $5^{th}$ panel thickness. The width of the skived portion of the $5^{th}$ panel is variable and generally it is approximately one-third of the width of the $5^{th}$ panel. The skiver section 12 may accomplish the skiving by a rotary milling apparatus or bell knife apparatus. In the preferred embodiment of the invention the skiver section 12 may be embodied by a computerized single scarf skiving machine, Model CSP or CSP2, manufactured by Fortuna Spezialmaschinen GmbH of Wiel der Stadt, Germany. However, in certain applications of the hemming apparatus 10, the skiving operation may not be necessary wherein the skiving section 12 may be omitted or removed, and the carton blanks are fed directly into the stepped creaser section 14(or a non-stepped creaser section, FIGS. 4B and 4C).

Figure 4A:
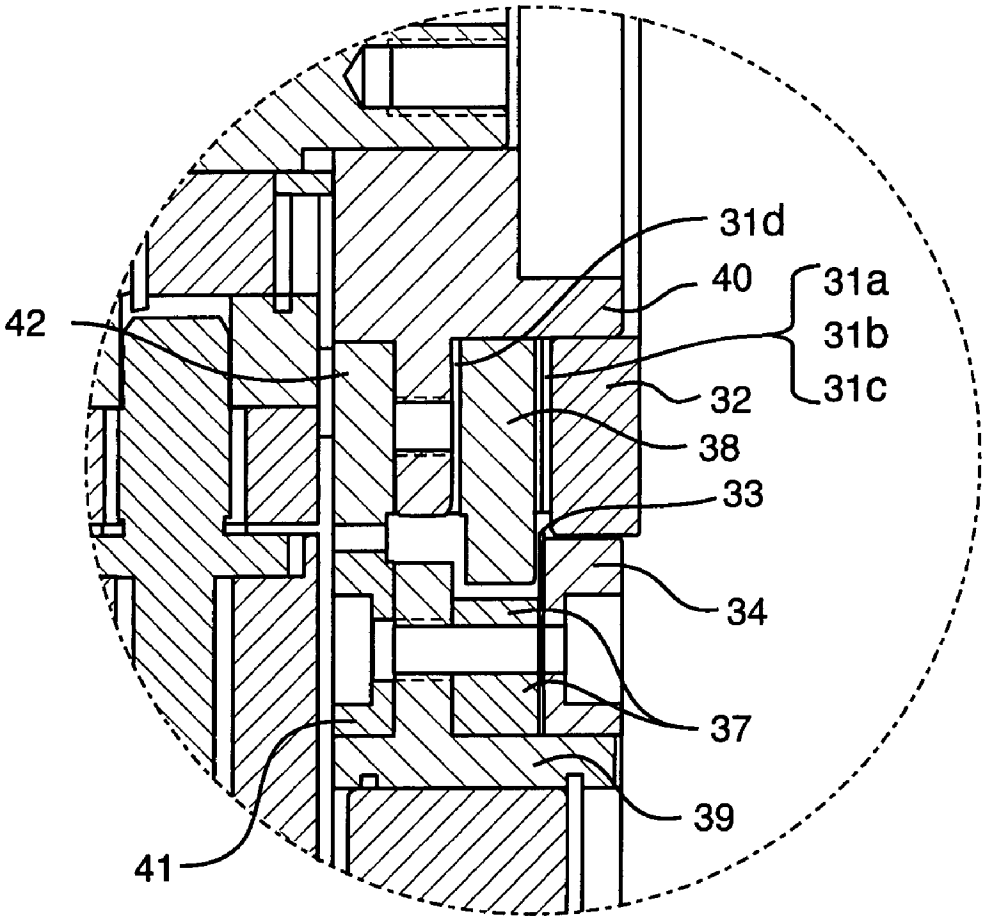
FIG. 4A is a cross sectional front elevational view of the area around a female stepped roll and a male stepped roll at their closest contact point to each other.
Figure 12:
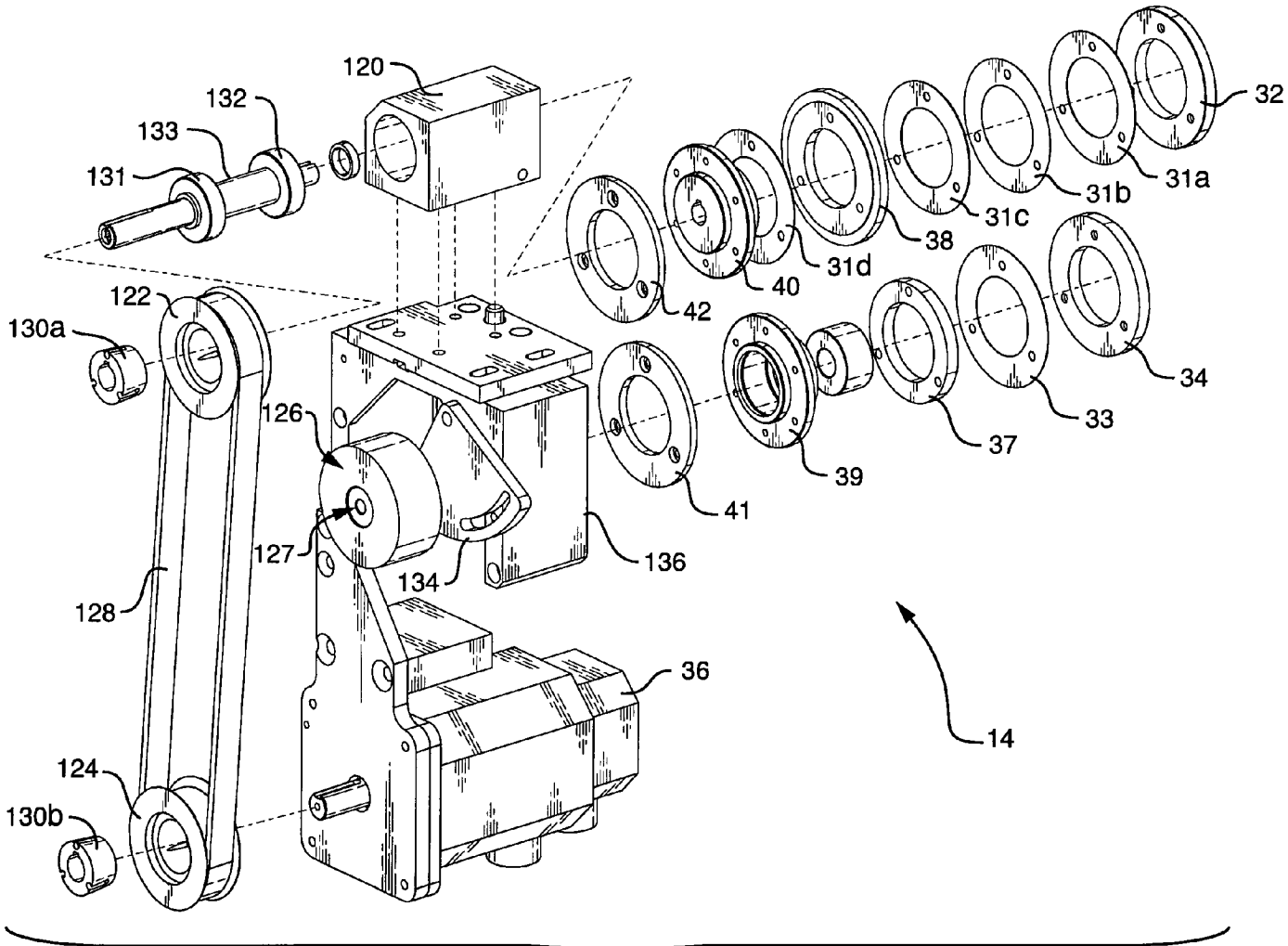
FIG. 12 is an exploded perspective view of a step creaser section of the skiver/hem/Preseal apparatus.

Referring to FIGS. 2A and 2B, FIG. 4A and FIG. 12, the carton blank 11 following the skiving operation passes next through the stepped creaser section 14 which comprises the two stepped creaser roll assemblies 34, 38. FIG. 12 is an exploded perspective view of the stepped creaser section 14 of the hemming apparatus 10, and FIG. 4A is an cross sectional front elevational view of the area around a top female stepped roll 38 and a bottom male stepped roll 34. The rolls 34, 38 are driven by a servo motor 36 which rotates both rolls 34, 38 via gears in the direction of carton blank flow at their closest contact point to each other. The top female stepped roll 38 at its 6 o' clock position is closest to the 12 o' clock position of the lower male stepped roll 34. The stepped creaser 14 puts a crease 188 (FIG. 15A) along the entire length of the skived portion 180 of the $5^{th}$ panel of the carton blank 11, and at the same time it folds the skived portion 180 downward along the full length of the crease 188 to be at approximately a 90 degree angle relative to the horizontal plane of the carton blank 11.

Still referring to FIG. 12, the female stepped roll 38 is mounted adjacent to three spacers 31*a*, 31*b*, 31*c* and the third spacer is adjacent to a top creaser roll 32. A spacer 31*d* is positioned on the other side of the top step creaser roll 38, and all of these parts mount on an upper hub 40. An upper spur gear 42 mounts to the other side of the upper hub 40. A shaft 133 extends from a bearing block 120 into the upper hub 40. The lower male stepped roll 34 is mounted adjacent to a creasing rule 33 and the other side of the creasing rule 33 mounts to a creaser roll 37 which mounts on a lower hub 39 having ball bearings in its center. A lower spur gear 41 attaches to the other side of the lower hub 39. The lower hub 39 and the lower spur gear 41 are driven by the upper spur gear 42 mounted to the upper hub 40. A Gates ploychain belt 128 mounts around an upper pulley 122 with bushing 130*a* in its center and a lower pulley 124 with bushing 130*b* in its center. A roll idler servo take-up 126 with ball bearings 127 in its center portion attaches to a take-up plate 134 which attaches to the frame 136 of the stepped creaser section 14. The servo motor 36 may be embodied by Model F-4030 manufactured by Allen Bradley of Milwaukee, Wis.

Figure 4B:
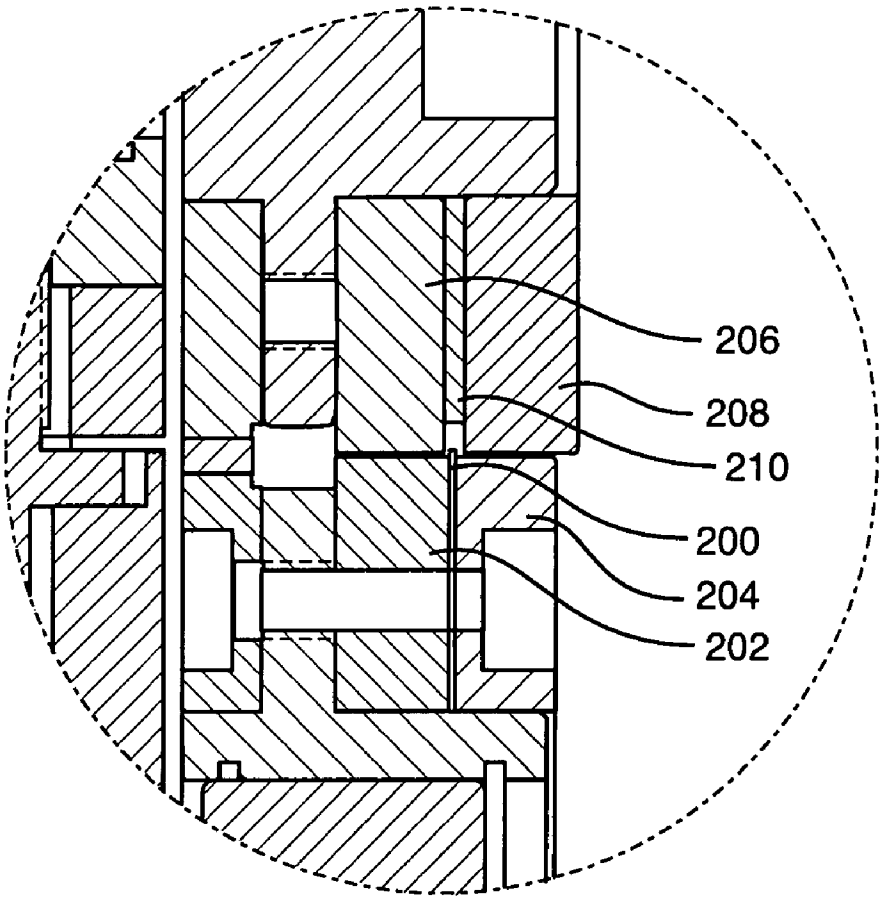
FIG. 4B is a cross sectional front elevational view of an alternate embodiment of a non-stepped creaser having a male creaser rule and rolls on the bottom and female creaser rolls on the top.
Figure 4C:
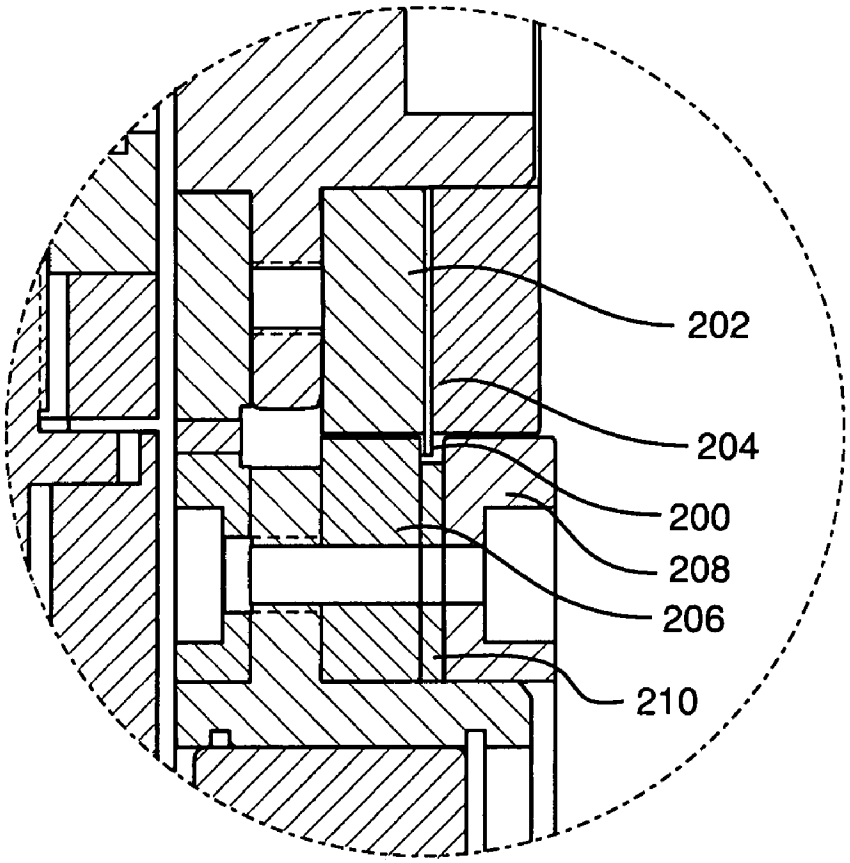
FIG. 4C is a cross sectional front elevational view of an alternate embodiment of a non-stepped creaser having a male creaser rule and rolls on the top and female creaser rolls on the bottom.
Figure 5:
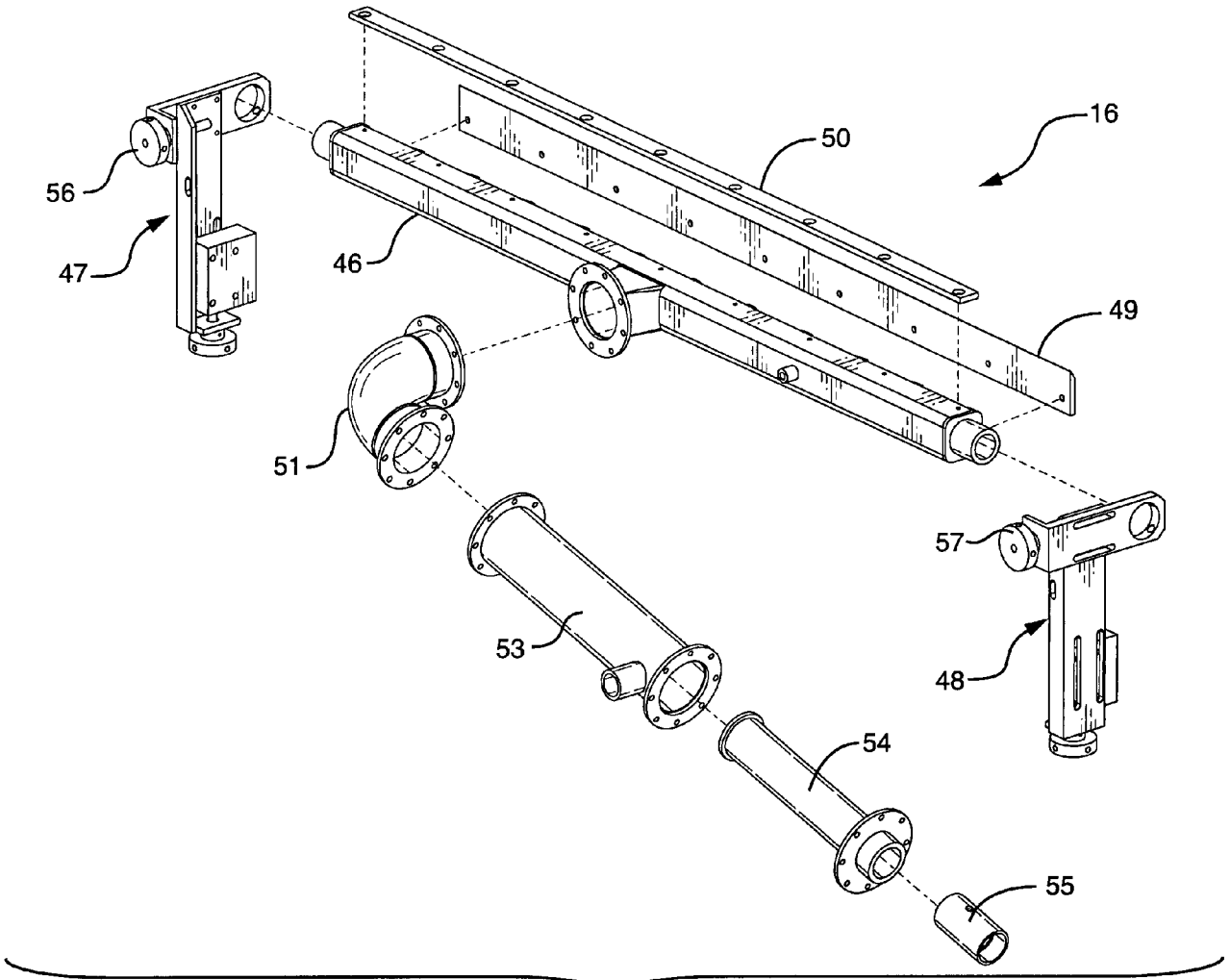
FIG. 5 is an exploded side perspective view of a hot air burner.
Figure 6:
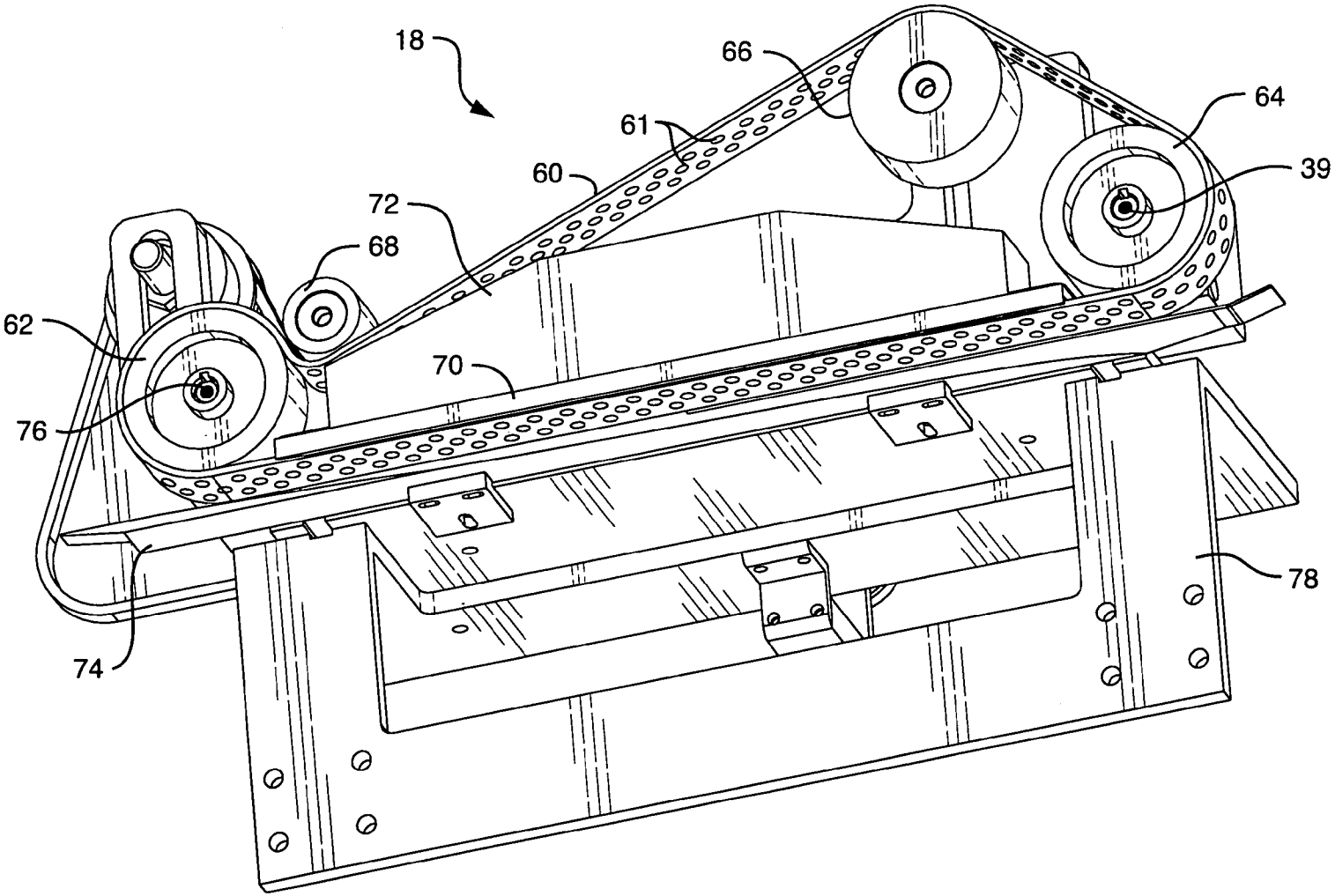
FIG. 6 is a left side perspective view of a vacuum hemmer section.

Referring to FIG. 4B and FIG. 4C, FIG. 4B is an alternate embodiment of a non-stepped creaser having a male creaser rule 200 and rolls 202, 204 on the bottom and female creaser rolls 206, 208 on the top. The thickness of the male creaser rule 200 is dependent on the thickness of the carton blank material. FIG. 4C is another alternate embodiment of a non-stepped creaser having the male creaser rule 200 and rolls 202, 204 on the top and the female creaser rolls 206, 208 on the bottom. The space 210 between the female creaser rolls 206, 208 is adjustable depending on the thickness of the carton blank material. The non-stepped creaser may be used in applications where less accurate hemming tolerances are acceptable. Next, the carton blank 11 passes through the burner section 16.

Referring now to FIGS. 2A, 2B, FIG. 5 and FIG. 16, FIG. 5 is an exploded side perspective view of the hot air burner section 16 which provides a narrow vertical stream of hot air 189 for heating thermoplastic material 182 on the $5^{th}$ panel edge 13 adjacent to the skived portion 180 of the carton blank 11. The burner 16 comprises a burner body 46 supported by end supports 47, 48. Each end support 47, 48 comprises a support adjustment 56, 57. Attached to a side of the burner body 46 is a side plate 49 and attached to the top of the burner body 46 is a top plate 50. The width of the stream of very hot air 189 coming out of the burner body 46 is determined by the space or opening 58 (FIG. 16) between the side panel 49 and the top plate 50. The temperature of the very hot air is approximately 500–600 degrees Centigrade. One end of a 90 degree elbow 51 attaches to the side of the burner body 46 and the other end of the elbow 51 attaches to a secondary air mixing sleeve 53. A combustion sleeve 54 is inserted within the secondary air sleeve 53 and bolted together, and a combustion nozzle 55 is threaded within the end of the primary air mixing sleeve 54.

Figure 7:
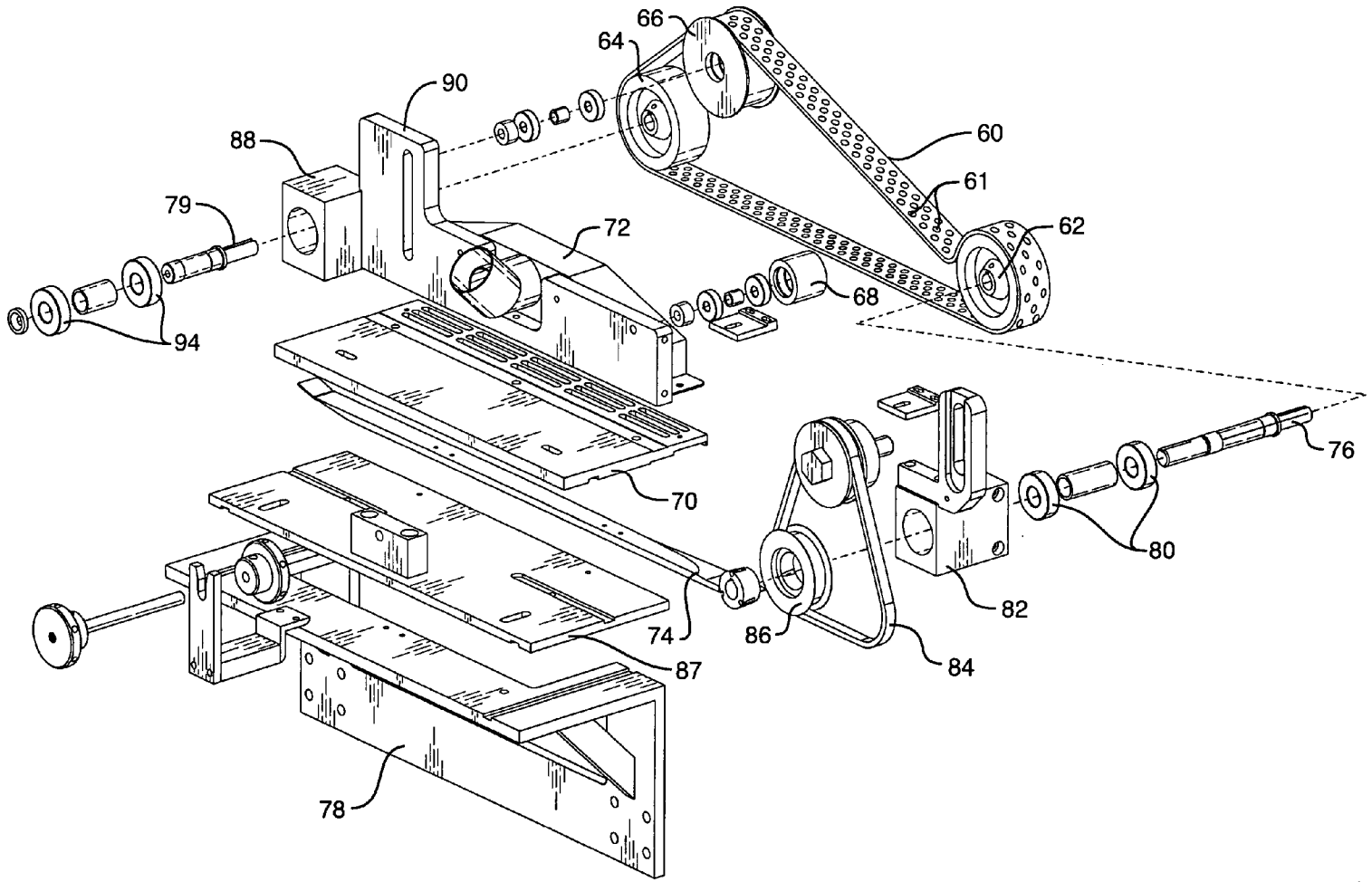
FIG. 7 is an exploded, right side perspective view of the vacuum hemmer section of FIG. 7.
Figure 8:
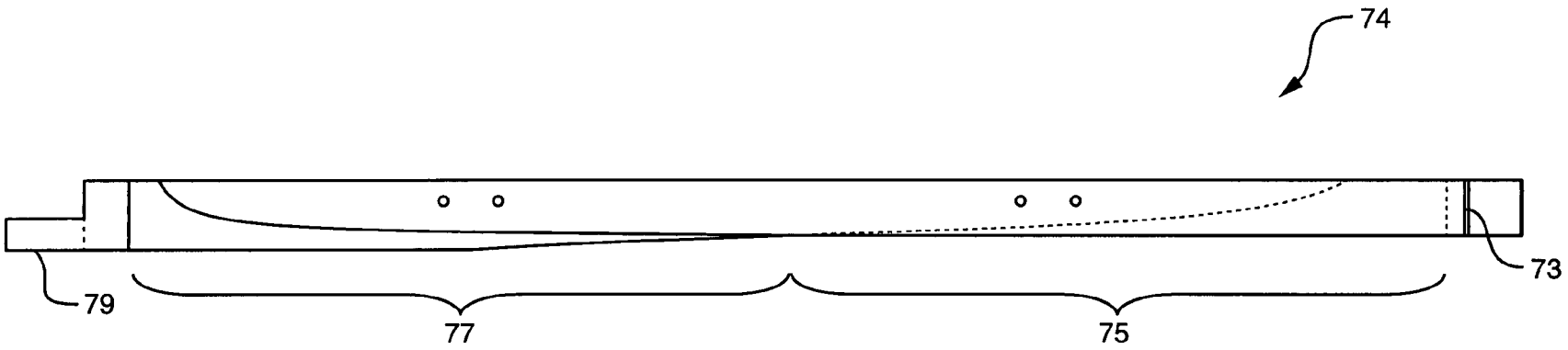
FIG. 8 is a top view of the hem folding spiral of the vacuum hemmer section of FIG. 4.

Referring to FIGS. 2A and 2B, FIG. 6 and FIG. 7, FIG. 6 is a left side perspective view of the vacuum hemmer section 18, and FIG. 7 is an exploded right side perspective view of the vacuum hemmer section 18. The carton blank 11 enters the vacuum hemmer section 18 after passing through the burner section 16. The skived portion 180 of the $5^{th}$ panel is folded down at approximately a 90 degree angle or less with respect to the horizontal plane of the carton blank 11. The vacuum hemmer section 18 comprises a driven belt 60, rolls 62, 64, 66, 68 for the continuous belt to move around, a vacuum chamber 72 positioned on a vacuum plate 70 with a plurality of elongated holes, a spiral 74 for folding the skived edge of the carton blank, belt driving means 62, 76 and a frame 78. The driving belt 60 comprises a plurality of holes 61, and the belt 60 moves around an idler roll 64 at a second end, continues on to the drive roll 62, and passes under an idler roll 68 and over an idler roll take-up 66. The belt 60 travels under a plate 70 which is coated with a friction reducing coating such as ceramic or Teflon impregnated hard chrome to reduce friction between the plate 70 and the belt 60. Above the plate 70 is a vacuum chamber 72 which sucks the carton blank 11 onto the surface of vacuum belt 60 as it comes in contact with the vacuum belt 60, and the carton blank 11 is securely held in place while the skived, creased edge portion 180 is folded downward and then upward onto the heated nonskived portion 182 of the $5^{th}$ panel 13 of the carton blank 11.

Referring to FIG. 7, a drive housing 82 supports the drive shaft 76 with ball bearings 80 mounted thereon. The drive shaft 76 attaches to pulley 86 which is driven by a belt 84. An idler mounting block 88 is attached to a take-up vertical mounting plate 90 and the hemmer plate 70. The idler mounting block 88 receives the shaft idler 79 and ball bearings 94 mounted thereon. The shaft idler 79 attaches to the center of the roll idler roll 64. The spiral 74 is attached to a vacuum hemmer section 18 adjusting plate 87.

Figure 9:
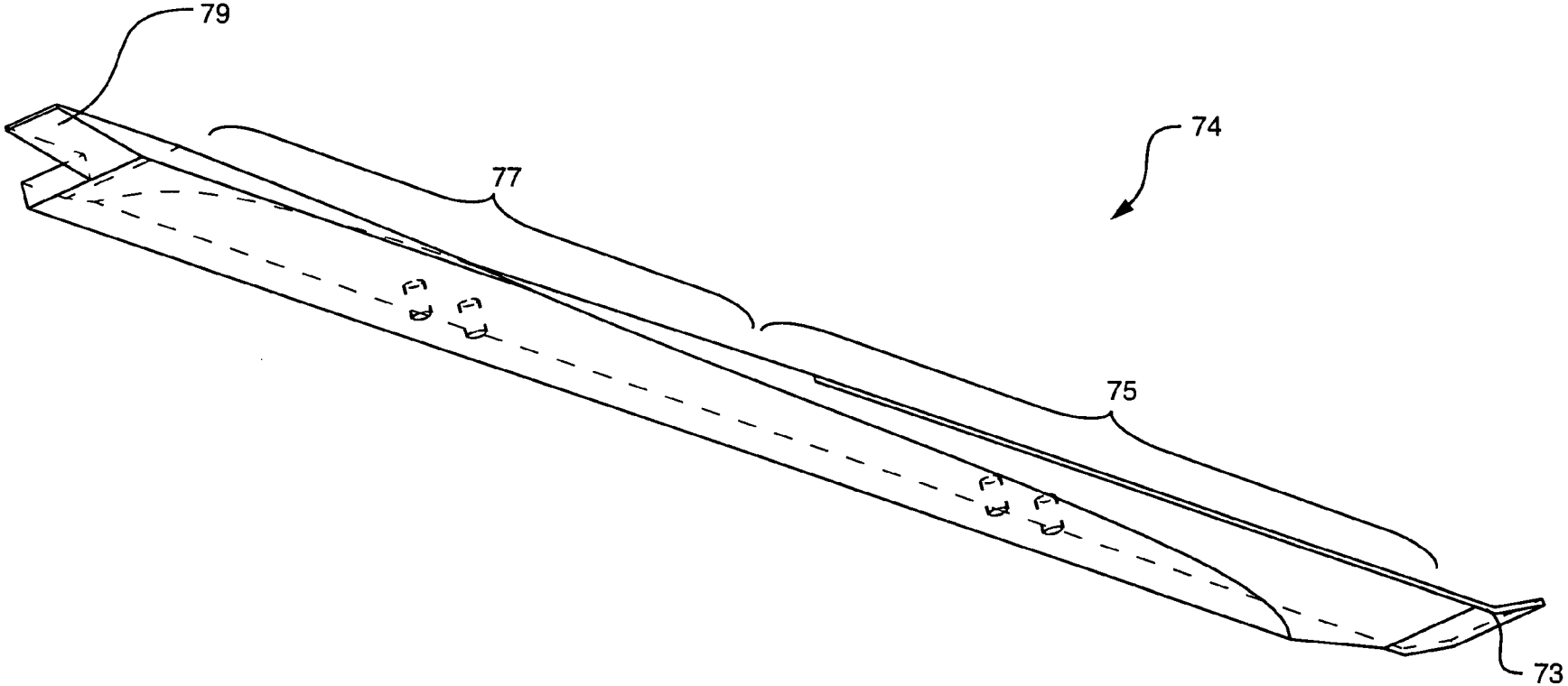
FIG. 9 is a bottom perspective view of a hem folding spiral of the vacuum hemmer section.

Referring to FIGS. 6, 7, 8 and 9, FIG. 8 shows a top view of the hem folding spiral 74 and FIG. 9 shows a bottom perspective view of the hem folding spiral 74. The spiral 74 is mounted on the vacuum hemmer adjusting plate 87 and comprises predetermined contoured surfaces which, during a first portion 75 of the full 180 degree spiral 74 causes the folded skived portion 180 edge of the $5^{th}$ panel 13 to be 90 degrees relative to the horizontal plane of the carton blank 11, and then a second portion 77 of the spiral 74 causes the skived portion 180 edge to fold under (from 90 degrees to 180 degrees) the adjacent unskived portion 182 of the $5^{th}$ panel 13. This folding of the skived portion 180 occurs as the carton blank 11, which is held against the belt of the vacuum hemmer section 18, passes in contact with the spiral 74.

The right end 73 of the spiral 74 is bent upward at an angle of approximately 15 degrees to guide the carton blank 11 into the spiral 74. The left end 79 of the spiral tapers off from bottom to top at approximately an 8–10 degree angle in order to control the folded hem 190 and guide the folded hem 190 into the sealer section 20.

Figure 10:
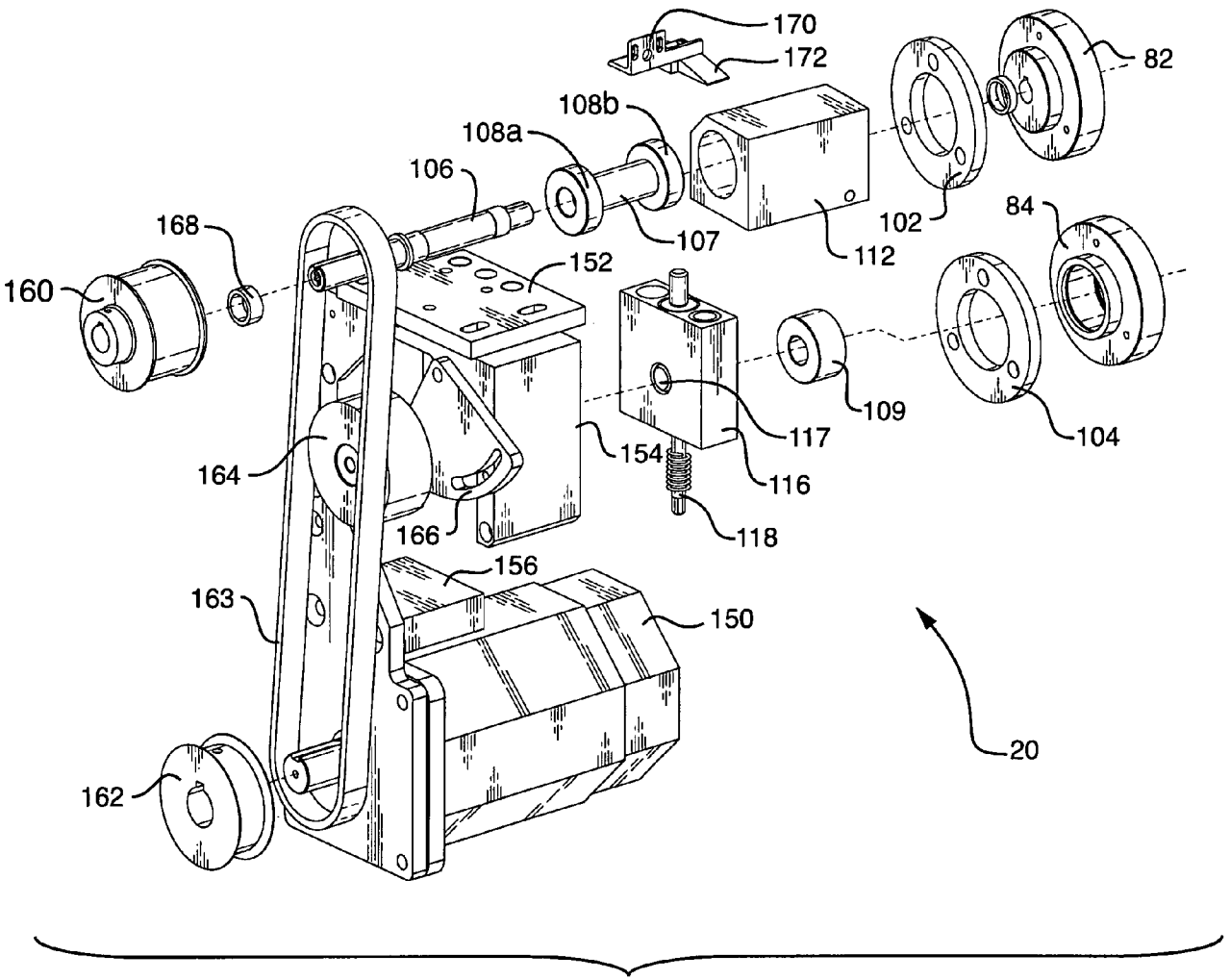
FIG. 10 is an exploded perspective view of a sealing rolls section of the skiver/hem/preseal apparatus.
Figure 11:
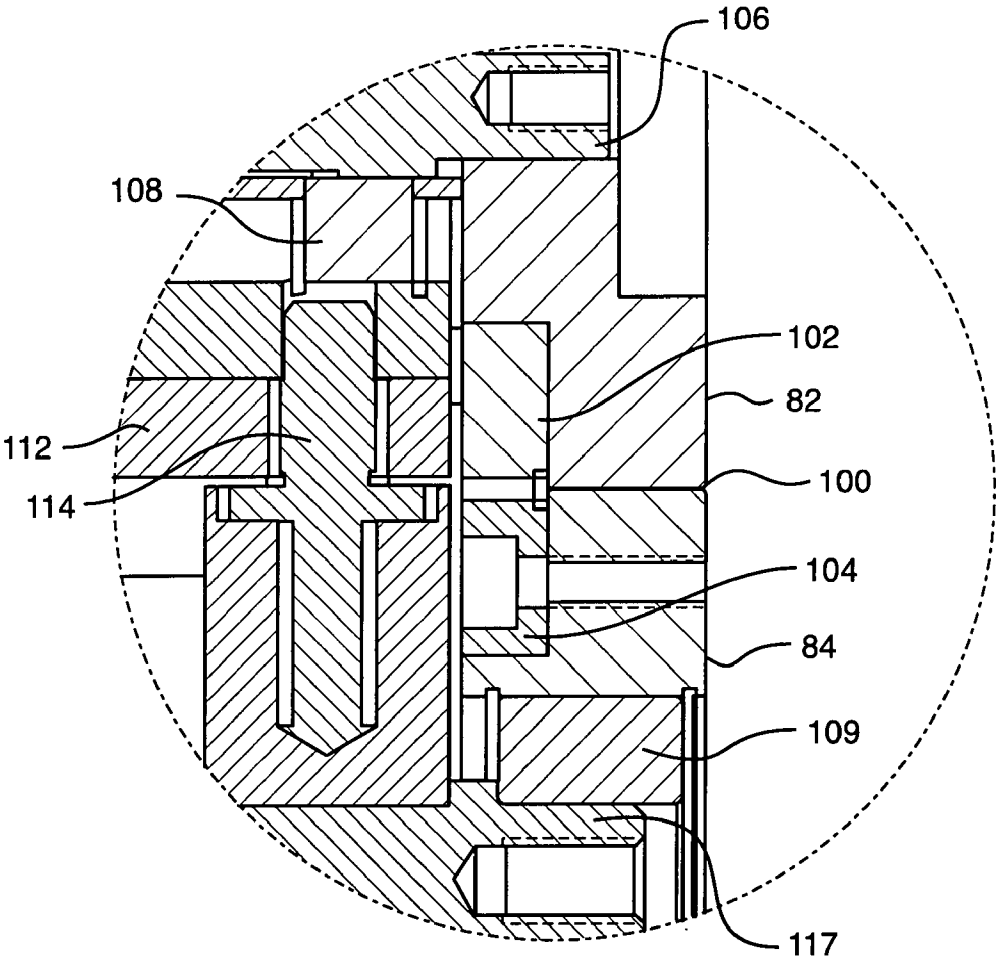
FIG. 11 is an cross sectional front elevational view of the area around an upper crusher roll and a lower crusher roll at their closest contact point to each other.

Referring to FIG. 3A, FIG. 10 and FIG. 11, FIG. 10 is an exploded, perspective view of the sealer section 20 of the hemming apparatus 10, and FIG. 11 is a cross sectional front elevational view of the area around an upper crusher roll 82 and a lower spring load crusher roll 84 of the sealer section 20 at their closest contact point space 100 to each other. After the carton blank 11 leaves the vacuum hemmer section 18, it enters the sealer section 20 where the folded hemmed portion 190 is in contact with the unskived portion 182 of the $5^{th}$ panel 13 (FIG. 18). As the hemmed edge passes through the contact point, space 100 between the upper crusher roll 82 and the lower crusher roll 84, the roll pressure forms a seal. The space 100 is spring loaded and adjustable and typically it is approximately 0.020 inches. The adjustment is made by adjusting screw 118.

In the sealer section 20, a servo motor 150 drives pulleys 160, 162. A Gates ploychain belt 163 attaches around the two pulleys 160, 162 and the idler servo take-up roll 164. The idler servo take-up roll 164 attaches to a take-up plate 166 which is used to tension drive belt 163. The take-up plate is attached to a support bracket 154. The plate 152 is mounted on top of the bracket 54 and is used to support bearing block 112. The upper pulley 160 is mounted on one end of a drive shaft 106, and the other end of the drive shaft 106 passes through a sleeve 107 having ball bearings 108*a* and 108*b* on either side. The ball bearings 108*a*, 108*b* and sleeve 107 with drive shaft 106 resides inside the bearing block 112, and the upper crusher roll 82 attaches to the drive shaft 106 which mounts within the bearing block 112. The spur gear 104 attaches to the lower driven crusher roll 84 and the ball bearing 109 is positioned within their center portions, and mounts on a pressed-in non-rotating shaft 117. The spur gear 104 is driven by spur gear 102 which is driven by drive shaft 106.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A hemming apparatus comprising:

means for conveying successive carton blanks along a paper line axis of said apparatus;

means for forming a crease a predetermined distance from an edge of said carton blank and folding said edge along said crease in a predetermined plane;

means for heating a thermoplastic coating on said unfolded portion of said edge adjacent to said crease;

means for folding said folded edge, under said heated unfolded portion of said edge, said folding means comprises a spiral attached to a vacuum hemmer;

means for sealing said folded portion of said edge under said unfolded portion of said edge having said heated thermoplastic coating to form a sealed hem on said edge of said carton blank;

said vacuum hemmer comprises a belt having a plurality of holes, said belt being positioned in a vertical plane around two spaced apart idler rolls, a drive roll and a take-up roll;

a plate having a plurality of openings is positioned immediately above a lower horizontally traveling portion of said belt;

a hood positioned on top of said plate for enabling a vacuum to retain each of said carton blanks as they move along said belt; and said spiral having predetermined contoured surfaces and mounted alongside said lower horizontally traveling portion of said belt for turning up to 180 degrees said previously folded edge of said carton blanks to place said folded edge under said heated unfolded portion of said edge.

2. The hemming apparatus as recited in claim 1 wherein said crease forming and folding means comprises a female stepped roll and a male stepped roll mounted in a plane opposite each other.

3. The hemming apparatus as recited in claim 1 wherein said heating means comprises a side panel and a top panel having a predetermined spacing for diverting streams of hot air toward the unfolded portion of said edge.

4. The hemming apparatus as recited in claim 1 wherein said plate having a plurality of openings comprises a coating of friction reducing material.

5. The hemming apparatus as recited in claim 1 wherein said sealing means comprises an upper crusher roll and a lower crusher roll, positioned in a plane opposite each other and spaced apart, for said folded portion under said heated unfolded portion to pass between said upper crusher roll and said lower crusher roll to form said sealed hem.

* * * * *